US007810321B2

(12) United States Patent
Yamashita et al.

(10) Patent No.: US 7,810,321 B2
(45) Date of Patent: Oct. 12, 2010

(54) RELIEF PRESSURE SWITCHING APPARATUS FOR HYDRAULIC WORKING MACHINE

(75) Inventors: Koji Yamashita, Hiroshima (JP); Koji Ueda, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 372 days.

(21) Appl. No.: 11/945,050

(22) Filed: Nov. 26, 2007

(65) Prior Publication Data

US 2008/0296522 A1 Dec. 4, 2008

(30) Foreign Application Priority Data

Nov. 27, 2006 (JP) ..... 2006-318396

(51) Int. Cl.
*E02F 9/22* (2006.01)
*F15B 11/08* (2006.01)

(52) U.S. Cl. ..... 60/328; 60/429

(58) Field of Classification Search ..... 60/368, 60/429, 328
See application file for complete search history.

(56) References Cited

U.S. PATENT DOCUMENTS 5,537,819 A * 7/1996 Kobayashi ..... 60/459
5,692,376 A * 12/1997 Miki et al. ..... 60/328
6,546,325 B1 * 4/2003 Kubota et al. ..... 91/361
7,478,530 B2 * 1/2009 Ueda ..... 60/328

FOREIGN PATENT DOCUMENTS

| | | | |
|---|---|---|---|
| JP | 04-049336 | | 2/1992 |
| JP | 11-100869 | | 4/1999 |
| JP | 2000-266007 | | 9/2000 |
| JP | 2002-294758 | | 10/2002 |
| JP | 2003-185042 | | 7/2003 |
| JP | 2004-74331 | | 3/2004 |
| JP | 2004-076411 | | 3/2004 |
| JP | 2004074331 | A * | 3/2004 |
| JP | 2006-177090 | | 7/2006 |
| JP | 2006177090 | A * | 7/2006 |

* cited by examiner

*Primary Examiner*—Thomas E Lazo
(74) *Attorney, Agent, or Firm*—Oblon, Spivak, McClelland, Maier & Neustadt, L.L.P.

(57) ABSTRACT

In a relief pressure switching apparatus for hydraulic working machine for switching a relief pressure of a hydraulic actuator circuit in accordance with a specification of a compression crushing apparatus or a breaker to be installed, electromagnetically variable relief valves for determining the relief pressure are provided, and a controller commands the relief pressure selected by an operator from a plurality of relief pressures preliminarily set and stored in combination with a flow rate as matching a working apparatus to the relief valves.

4 Claims, 6 Drawing Sheets

SWITCH FOR CHANGING WORK
15
23
14
11
CONTROLLER
DISPLAY/ OPERATION UNIT
18
13
y
x
12
a
b
12a
8,9
HYDRAULIC ACTUATOR
19
T
20
T
5
PRESSURE SIGNAL TO CONTROLLER
T
22
7
21
FLOW RATE COMMAND SIGNAL FROM CONTROLLER
6
14

RELIEF PRESSURE SWITCHING APPARATUS FOR HYDRAULIC WORKING MACHINE

BACKGROUND OF THE INVENTION

1. Field of the Invention

The present invention relates to a relief pressure switching apparatus for hydraulic working machine for switching a relief pressure in accordance with a specification of a working apparatus to be installed (such as a compression crushing apparatus and a breaker).

2. Description of the Related Art

For example, in a crusher for crushing a building or the like, there is a case where a working apparatus is selected and used from two types in accordance with a purpose.

FIGS. 4 and 5 exemplify the crusher formed by having a hydraulic excavator as a base.

The above crusher is formed by installing a working attachment 2 capable of raising, lowering, bending and stretching in a crawler traveling type base machine 1. At a front end of the working attachment 2, is attached a compression crushing apparatus 3 of an openable and closable type (FIG. 4) called as a nibbler, or a breaker 4 of an oscillating type (FIG. 5) as the working apparatus in accordance with contents of work. In the following, work performed by the compression crushing apparatus 3 is referred to as compression crushing work, and work performed by the breaker 4 is referred to as breaker work.

In this case, hydraulic actuators are different between the compression crushing apparatus 3 and the breaker 4, and oil supply and discharge routes for both the actuators are required to be different from each other. Therefore, there is a need for switching a circuit state of a hydraulic circuit in accordance with the working apparatus to be installed.

FIG. 6 shows the hydraulic circuit having a function of automatically switching the above circuit state.

The reference numeral 5 denotes a control valve of a hydraulic pilot switching type operated by a remote controlling valve 6 of a pedal operating type for example. The reference numeral 7 denotes a hydraulic pump serving as an actuator hydraulic source, and T denotes a tank. At the time of operating the control valve 5, oil from the hydraulic pump 7 is fed to a compression crushing cylinder 8 or a breaker cylinder 9 serving as the hydraulic actuator so as to operate the compression crushing cylinder 8 or the breaker cylinder 9.

Here, at the time of the compression crushing work, as well as a general cylinder circuit, both an inlet side and an outlet side of the compression crushing cylinder 8 are connected to the hydraulic pump 7 and the tank T through the control valve 5.

Meanwhile, at the time of the breaker work, when a back pressure is generated in a return line of the breaker cylinder 9 by a squeezing effect of the control valve 5, power of the breaker 4 in FIG. 5 is weakened and at worst the breaker 4 is stopped. Due to the above reason or the like, there is a need for directly connecting the return line of the breaker cylinder 9 to the tank T.

For switching the above circuit state, a switching valve 11 controlled by a controller 10 is provided.

The above switching valve 11 is formed by a main valve 12 of a hydraulic pilot switching type for switching between a compression crushing work position a and a breaker work position b, and an electromagnetic valve 13 for controlling the switching of the main valve 12 on the basis of an electric signal from the controller 10.

The electromagnetic valve 13 is provided with a compression crushing work position x for blocking a pilot pressure from a pilot hydraulic source 14 (also serving as a pilot hydraulic source for the remote controlling valve 6) to a pilot port 12*a* of the main valve 12 (for communicating the pilot port 12*a* to the tank T), and a breaker work position y for supplying the pilot pressure to the pilot port 12*a*.

The above switching valve 11 works as in the following or the like.

In a state that the switch for changing work 15 is operated to the compression crushing work side, the electric signal is not sent from the controller 10 to the electromagnetic valve 13. Therefore, the electromagnetic valve 13 and the main valve 12 are at the compression crushing work positions x and a respectively as shown in the figure.

Consequently, there is a state that lines on the both sides of the compression crushing cylinder 8 are connected to the hydraulic pump 7 and the tank T respectively through the control valve 5.

Meanwhile, when the switch for changing work 15 is switched to the breaker work side, the electromagnetic valve 13 is switched to the breaker work position y by the electric signal from the controller 10. Therefore, the main valve 12 is also switched to the breaker work position b.

Consequently, the return line of the breaker cylinder 9 is directly connected to the tank T without passing through the control valve 5.

In FIG. 6, the reference numerals 16 and 17 denote relief valves for determining a maximum pressure of a hydraulic actuator circuit.

As mentioned above, the technique of automatically switching a circuit state by the switching valve in accordance with the type of the working apparatus is shown in Japanese Patent Laid-Open No. 2003-185042.

The compression crushing apparatus 3 and the breaker 4 have different flow rates and work pressures of the cylinders 8 and 9 from each other.

Therefore, a variable capacity type pump is used as the hydraulic pump 7, and tilting of the pump 7 is controlled by the signal from the controller 10 on the basis of the operation of the switch for changing work 15 so that a discharge amount of the pump is adjusted.

With regard to the work pressure, by using relief valves of a manually variable type (mechanical relief valves) as the relief valves 16 and 17, a set pressure is changed to a value determined in relation with a specified flow rate.

Meanwhile, a technique of automatically switching a relief pressure between high and low by a method of dividing two types between a breaker and other working apparatuses is shown in Japanese Patent Laid-Open No. 2002-294758.

As mentioned above, the technique of manually switching a circuit pressure in accordance with the type of the working apparatus to be installed, and the technique of automatically switching between high and low are publicly known respectively.

However, even with the same type of working apparatus, a flow rate thereof is different in accordance with a specification thereof, and a pressure thereof is different in accordance with the flow rate. Therefore, there is a need for variously switching the circuit pressure in accordance with not only the type of working apparatus but also the specification.

In this case, the publicly known technique of automatically switching is not capable of satisfying the above request. In the technique of manually switching, for every time the working apparatus is exchanged, the relief valves 16 and 17 are manually operated according to the specification or the like so as to adjust the set pressure again, and the switching operation is very troublesome.

SUMMARY OF THE INVENTION

It is an object of the present invention to provide a relief pressure switching apparatus for hydraulic working machine capable of automatically switching a relief pressure in accordance with a working apparatus by a remote operation which is a selection operation.

The present invention is a relief pressure switching apparatus for hydraulic working machine for switching a relief pressure of a hydraulic actuator circuit in accordance with the type of a working apparatus to be installed, comprising electromagnetically variable relief valves for determining the relief pressure and a controller. The controller stores a plurality of relief pressures preliminarily set in combination with a flow rate of oil, and commands a relief pressure selected from the stored relief pressures as matching the working apparatus to the relief valve.

According to the present invention, the controller commands the relief pressure selected from the plurality of relief pressures preliminarily set and stored in combination with the flow rate to the electromagnetically variable relief valves. Therefore, it is possible to automatically switch the relief pressure following exchange of the working apparatus only by the selection operation.

Further, since the relief pressure is set and stored in combination with the flow rate and then selected, it is possible to switch the flow rate and the relief pressure at the same time.

It is preferable that in the above configuration, the controller is adapted to be switched between a setting mode for setting a plurality of relief pressures and a selection mode for selecting a relief pressure from the plurality of relief pressures set in the setting mode, and in the setting mode, by the controller, the relief pressure is set on the basis of a pressure generated when a hydraulic actuator is actually brought into action by the flow rate to be combined for the working apparatus to be installed.

In this case, in the setting mode of the relief pressure, the controller sets the relief pressure on the basis of the pressure generated when the hydraulic actuator is actually brought into action by the flow rate determined for the working apparatus to be installed. Therefore, there is no fear that a set pressure is different from an actual pressure due to dispersion of the relief valves unlike the case of setting as in a specification. That is, it is possible to set a precise relief pressure.

It is preferable in the present invention that in the above configuration, a display portion for displaying the relief pressure on a screen of a display device in the setting mode and the selection mode, and an operation portion for setting the relief pressure in the setting mode and selecting the relief pressure in the selection mode are provided.

In this case, in both the setting mode and the selection mode, it is possible to select the relief pressure following a screen display and hence operations in both the modes are easy. Further, since it is possible to share the display portion and the operation portion in both the setting mode and the selection mode, it is advantageous in terms of equipment cost and space.

It is preferable in the present invention that in any of the above configurations, a compression crushing apparatus of an openable and closable type and a breaker of an oscillating type are selectively installed as the working apparatus, and the controller stores the plurality of relief pressures preliminarily set in combination with the flow rate for both the compression crushing apparatus and the breaker, and commands the relief pressure selected for the installed working apparatus to the relief valves.

In this case, it is possible to select and automatically switch the relief pressure both for the compression crushing apparatus and the breaker which are frequently used in a crusher.

It is preferable in the present invention that in the above configuration, the controller is adapted to store and select the plurality of relief pressures on both the oil supply and oil discharge sides to and from the hydraulic actuator for the compression crushing apparatus, and the plurality of relief pressures only on the oil supply side to the hydraulic actuator for the breaker.

In this case, it is possible to select and automatically switch the relief pressure both for the compression crushing apparatus and the breaker which are frequently used in the crusher.

It is possible to switch the relief pressure in accordance with a difference in a circuit state that in the compression crushing apparatus, both an inlet side and an outlet side of a compression crushing cylinder are connected to a hydraulic pump and a tank through the control valve, whereas in the breaker, a return line of a breaker cylinder is directly connected to the tank.

DESCRIPTION OF THE PREFERRED EMBODIMENTS

With an explanation of THE RELATED ART, an embodiment exemplifies a crusher in which a compression crushing apparatus and a breaker are selectively installed as a working apparatus as a subject to which the present invention is applied.

Figure 1:
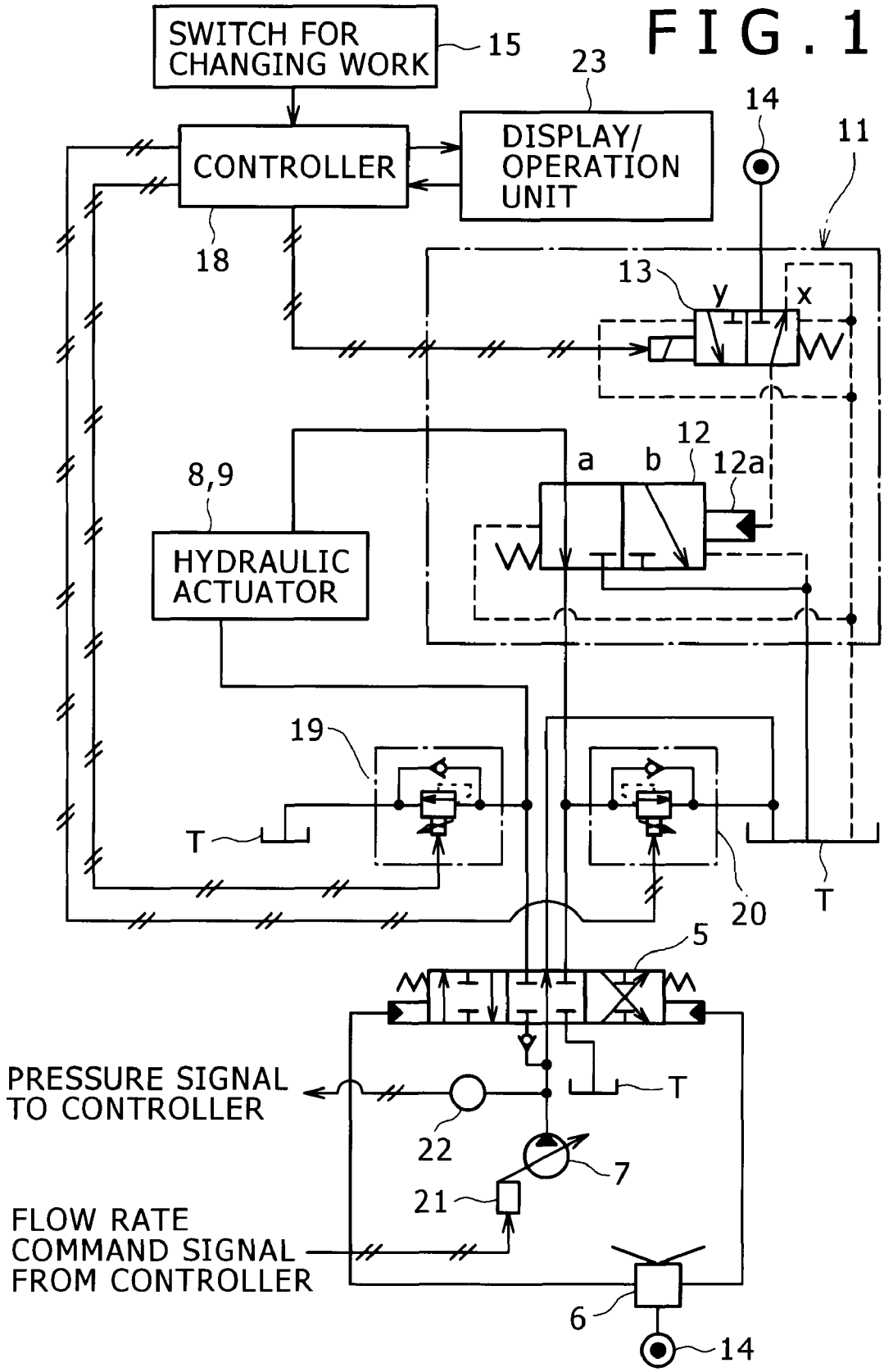
FIG. 1 is a diagram of a hydraulic circuit including a relief pressure switching apparatus according to an embodiment of the present invention.
Figure 6:
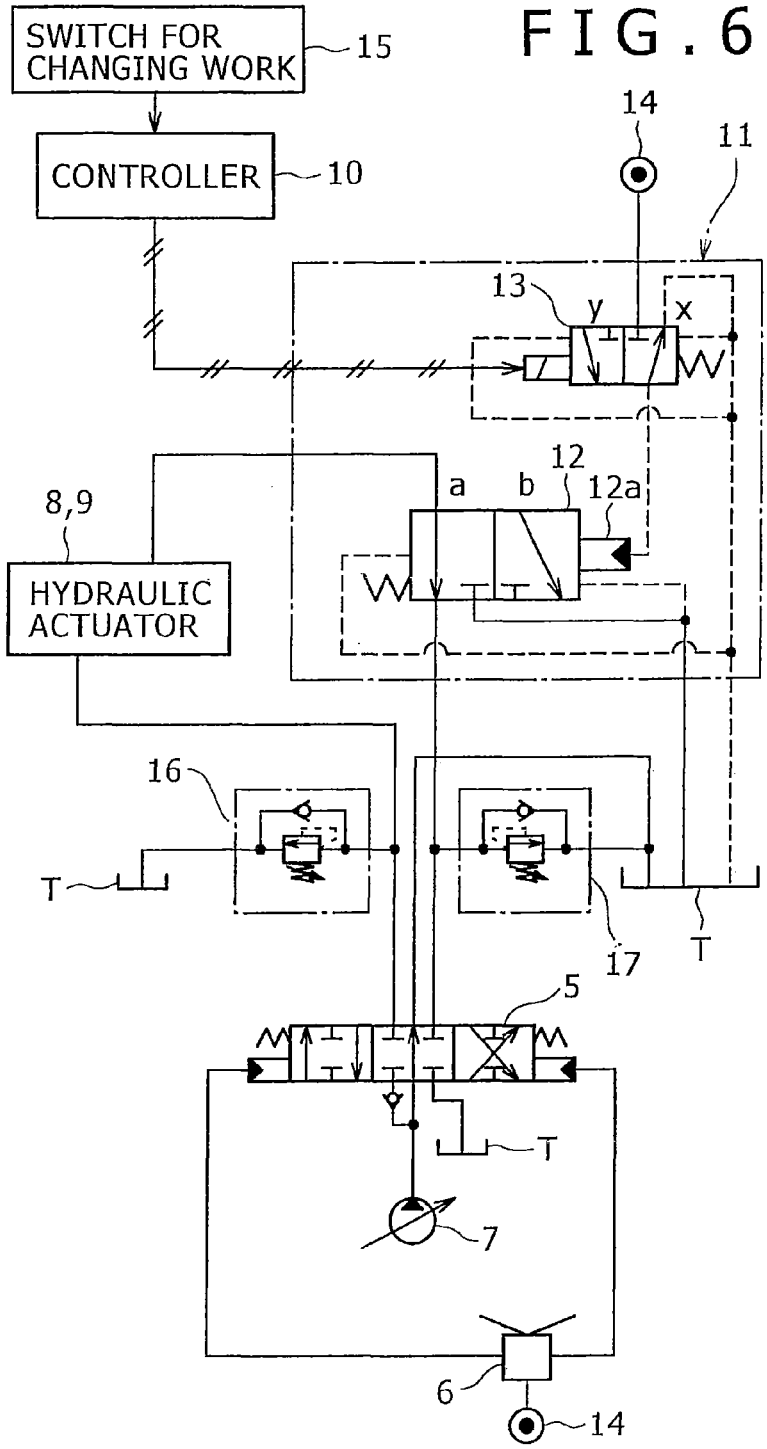
PRIOR ART FIG. 6
FIG. 6 is a diagram of a hydraulic circuit showing THE RELATED ART of manually switching the relief pressure.

FIG. 1 shows a configuration of a hydraulic circuit including a relief pressure switching apparatus according to the embodiment. In FIG. 1, the same parts as in a circuit of THE RELATED ART shown in FIG. 6 are shown by the same reference numerals and a repeated explanation thereof is omitted.

The embodiment is the same as the circuit of THE RELATED ART in terms of the following points:

(i) a control valve 5 controls an action of a compression crushing cylinder 8 or a breaker cylinder 9;

(ii) a switching valve 11 for switching a circuit state in accordance with the compression crushing apparatus and the breaker is provided; and (iii) the switching valve 11 is formed by a main valve 12 of a pilot switching type and an electromagnetic valve 13 for controlling the switching of the main valve 12 on the basis of a command signal (electric signal) from a controller 18 on the basis of a operation of a switch for changing work 15.

In the embodiment, as relief valves for determining a maximum pressure of the circuit, electromagnetically variable relief valves 19 and 20 are provided in both side pipe lines connecting a hydraulic pump 7 and a hydraulic actuator 8 or 9. A set pressure of the both the relief valves 19 and 20 (in the case of the breaker, only the relief valve 19 on the supply side of pressure oil) is switched by a command signal from the controller 18 within a cabin.

A pump regulator 21 for controlling a discharge flow rate (tilting) of the hydraulic pump 7 of a capacity variable type is controlled by the controller 18. In accordance with a specification of the working apparatus (irrespective of the type), a flow rate of the actuator is changed.

Further, a pressure sensor 22 is connected to a pump discharge circuit, and a pump discharge pressure (circuit pressure) is detected by the pressure sensor 22 and sent to the controller 18.

Meanwhile, to the controller 18, is connected a display/operation unit 23 formed by integrating a display portion for displaying the relief pressure and the like on a screen of a display device and an operation portion. By the controller 18 and the display/operation unit 23, a plurality of relief pressures are set in combination with the flow rate and the relief pressure is selected at the time of exchanging the working apparatus.

The above point will be described.

The controller 18 is, by mode switching means (not shown), adapted to be switched between a relief pressure setting mode for preliminarily setting the relief pressure by a serviceman at the stage of shipping the machine or the like and a relief pressure selection mode for selecting the relief pressure by an operator of the machine at the time of exchanging the working apparatus. The controller 18 is operated in both the modes as follows.

Figure 2:
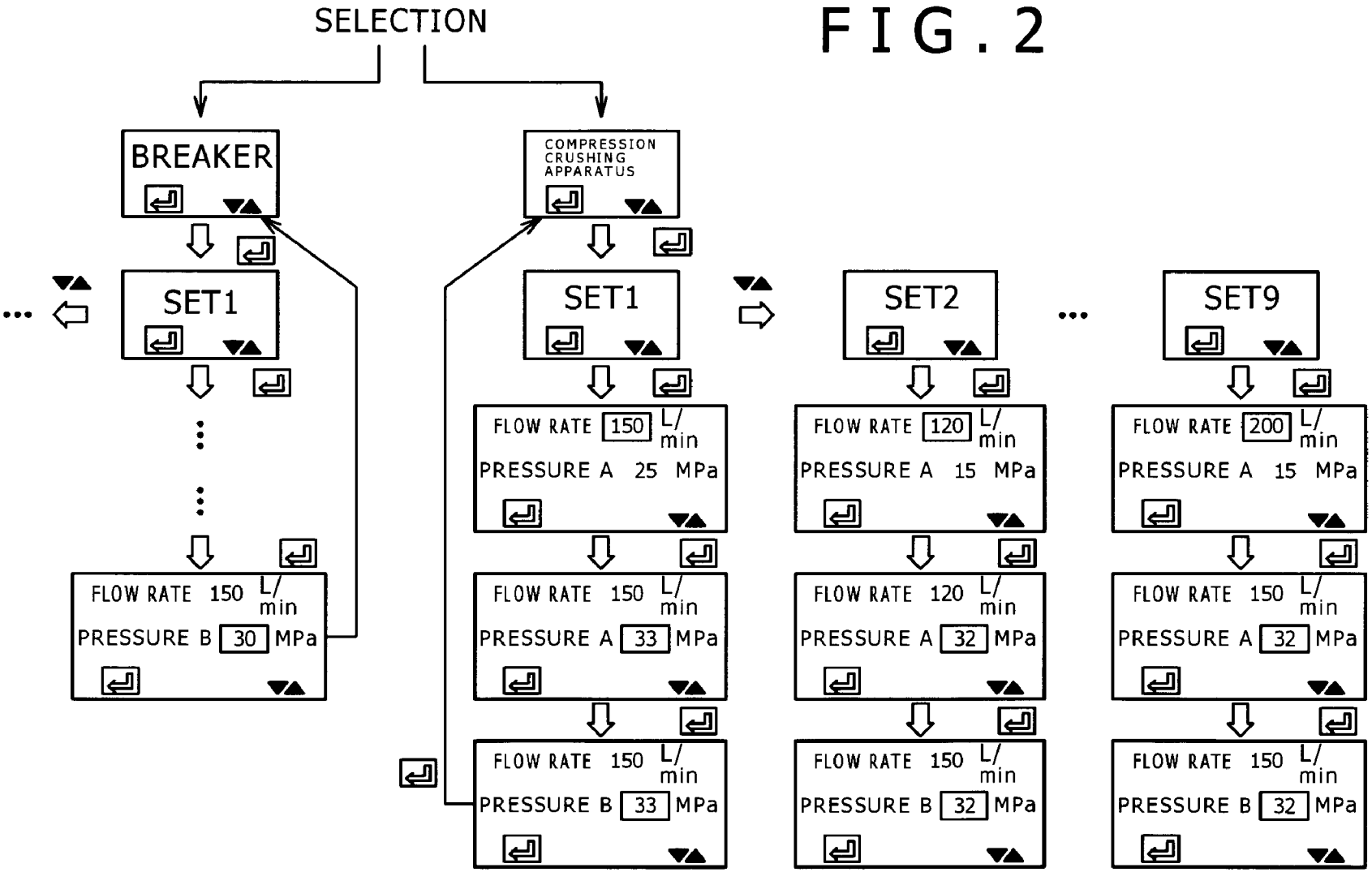
FIG. 2 is a diagram for explaining an operation procedure of setting a relief pressure according to the embodiment.

Relief Pressure Setting Mode (Refer to FIG. 2)

On the right side of FIG. 2, is shown a setting operation procedure for the compression crushing apparatus, and on the left side is shown a setting operation procedure for the breaker. It should be noted that only a part of the setting operation procedure for the breaker is shown as basically the same as the setting operation procedure for the compression crushing apparatus.

With taking the compression crushing apparatus as an example, when the compression crushing apparatus is selected by a key operation of the display/operation unit 23 in FIG. 1 (or a touch operation of a touch panel), letters of the "compression crushing apparatus" to be installed are displayed on the screen as shown on the uppermost area of the figure.

Next when a return key is pressed, as shown on the lower side of the figure, the screen is switched to a screen showing the type of setting (for example SET1 to SET9) changed in accordance with the specification of the compression crushing apparatus. The screen is successively switched by a forward/back key operation.

For example, when the return key is pressed in SET1, the screen is switched to a screen for determining a combination between the flow rate and the pressure, and firstly the flow rate is determined in accordance with the specification for the working apparatus which is selectively used. The figure shows the case where the flow rate is determined as 150 L/min. A signal of the determined flow rate is sent from the controller 18 in FIG. 1 to the pump regulator 21 so as to adjust a pump discharge amount.

Next when the return key is pressed, the screen is moved to a screen for setting the pressure of both the relief valves 19 and 20 in FIG. 1. In such a state, a remote controlling valve 6 is operated so as to bring a hydraulic actuator (compression crushing cylinder) 8 into action. At the time, the maximum pressure detected by the pressure sensor 22 is displayed on the screen.

The figure shows the case where a pressure A (set pressure of the relief valve 19) is 33 MPa. When the return key is pressed, the above pressure is set. A pressure B (set pressure of the relief valve 20) is set in the same way.

It should be noted that the pressure may be set as a value which is slightly lower or higher than the detected pressure.

When a setting operation in SET1 is finished, the flow is moved to SET2 by a return key operation. In the following, the same procedure and the same operation are used for performing the setting up to SET9. With regard to the breaker on the left side of the figure (only the relief valve 19), the same setting is performed.

Figure 3:
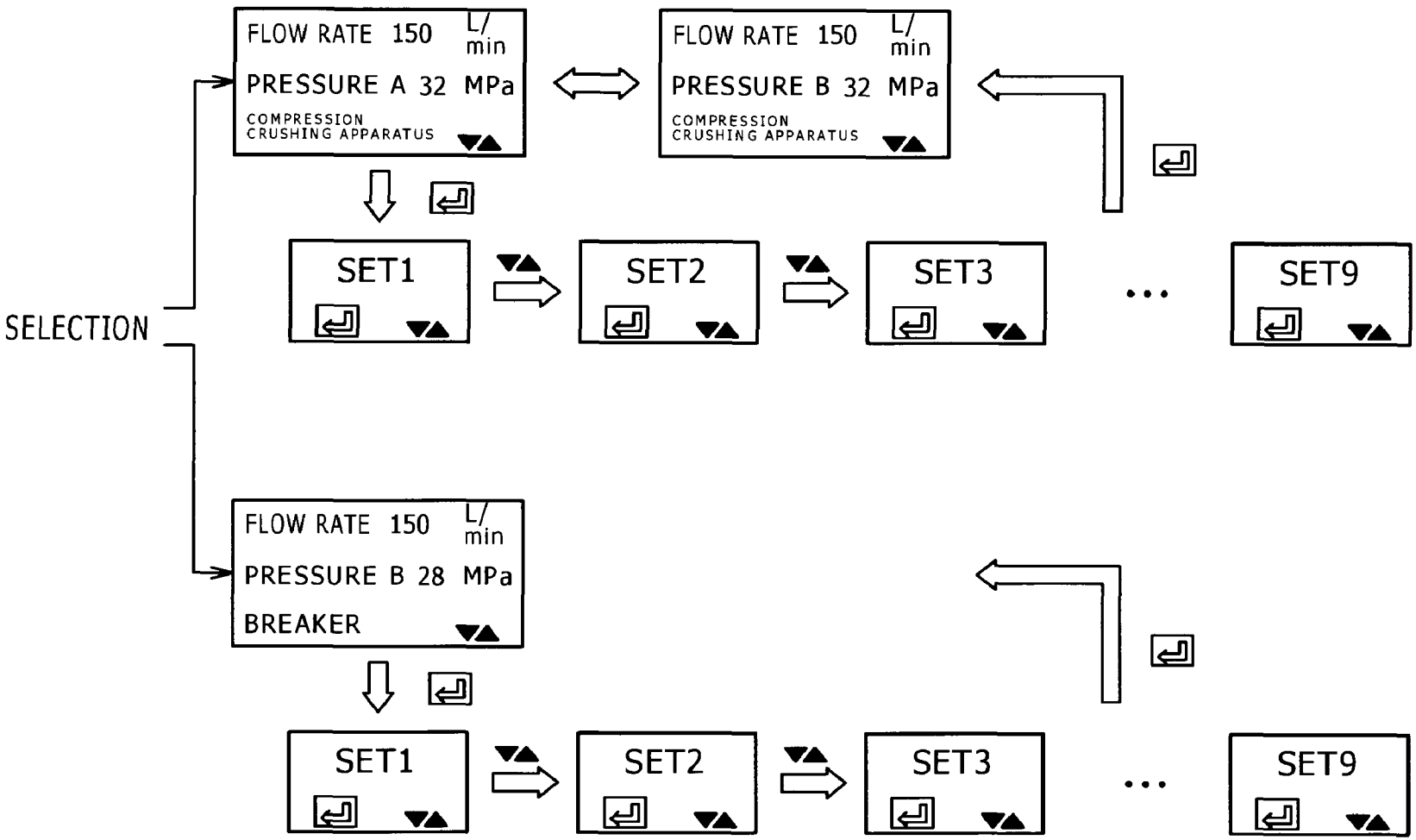
FIG. 3 is a diagram for explaining an operation procedure of selecting the relief pressure according to the embodiment.
Figure 4:
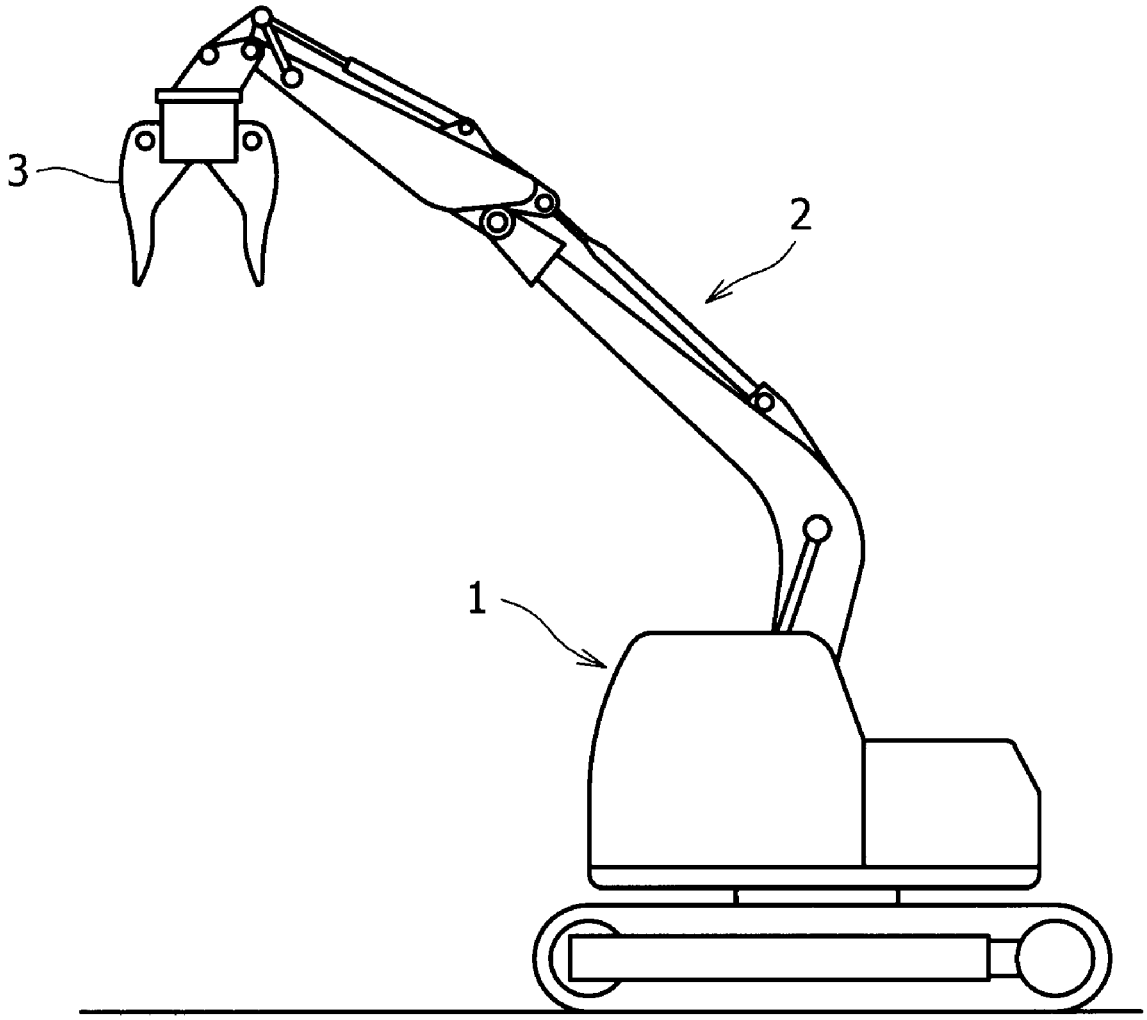
FIG. 4 is a schematic side view of a crusher in which a compression crushing apparatus of an openable and closable type is attached to a working attachment.
Figure 5:
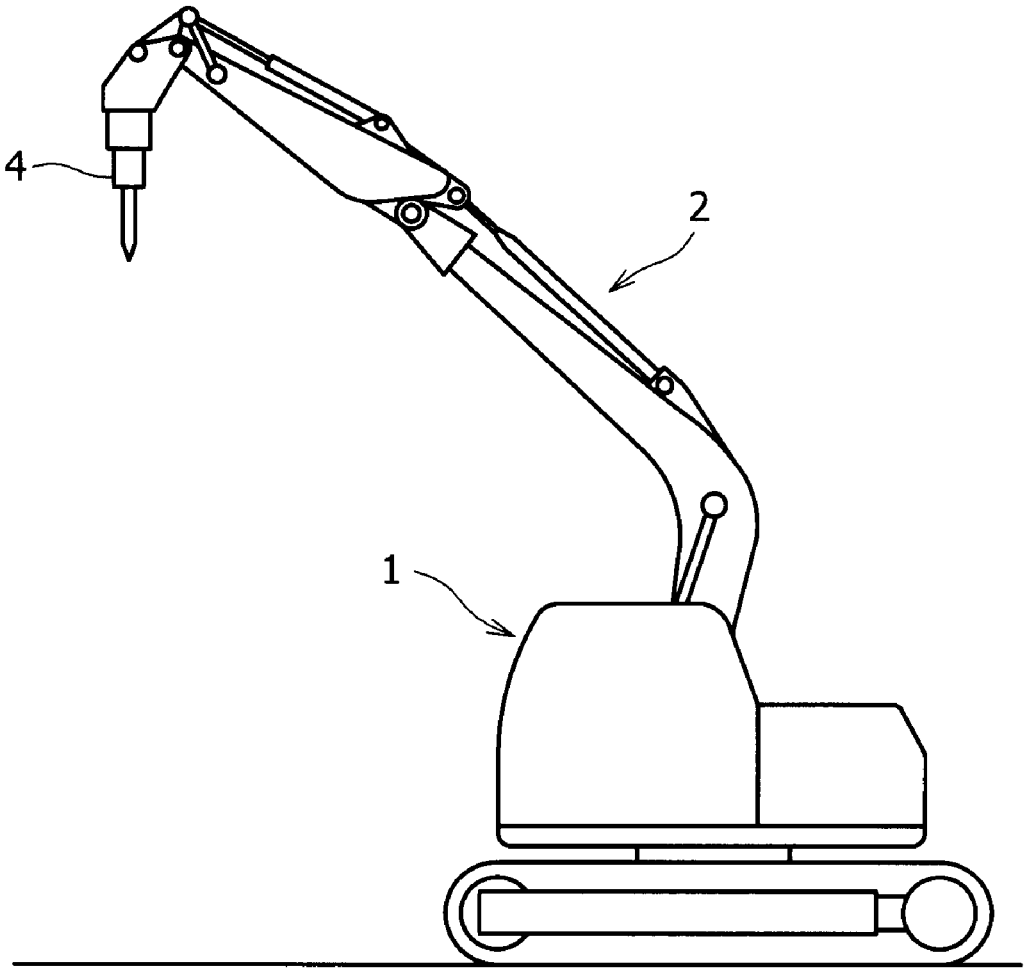
FIG. 5 is a schematic side view of the crusher in which a breaker is attached to the working attachment.

Relief Pressure Selection Mode (Refer to FIG. 3)

At the time of exchanging the working apparatus, the compression crushing apparatus or the breaker is selected as the working apparatus and on the screen of the display/operation unit 23, provisional values of the flow rate and the pressure of the selected working apparatus (for example, the flow rate and the pressure of a working apparatus which is used immediately before the selected working apparatus) are displayed.

When the return key is pressed, the screen is switched to a screen for selecting the relief pressure on the lowest area of the figure. After one of SET1 to SET9 is selected by the forward/back key operation, the combination between the flow rate and the pressure selected for both the relief valves 19 and 20 is determined.

On the basis of the selection operation, command signals of the pump discharge amount and the relief pressure are sent from the controller 18 to the pump regulator 21 and the relief valves 19 and 20 (in the case of the breaker, only the relief valve 19), and hence the flow rate and the pressure of the circuit are determined.

It should be noted that when the return key is pressed in SET1 to SET9 on the screen for selecting the relief pressure, the screen is switched to a screen displaying the combination between the flow rate and the pressure on the uppermost area of the figure. Therefore, it is possible to confirm contents from SET1 to SET9 on the screen.

As mentioned above, the relief pressure selected by the operator from the plurality of relief pressures preliminarily set and stored in combination with the flow rate is commanded from the controller 18 to the electromagnetically variable relief valves 19 and 20. Therefore, it is possible to automatically switching the relief pressure following exchange of the working apparatus only by the selection operation within the cabin.

Further, since the relief pressure is set and stored in combination with the flow rate and then selected, at the time of exchanging the working apparatus, the flow rate and the relief pressure are switched at the same time.

In the setting mode for preliminarily setting the relief pressure, the maximum pressure generated when the hydraulic actuator 8 or 9 is actually brought into action by the flow rate determined for the working apparatus to be installed is detected by the pressure sensor 22, and on the basis of the detected value, the relief pressure is set by the controller. Therefore, there is no fear that the set pressure is different from an actual pressure due to dispersion of the relief valves 19 and 20 unlike the case of setting as in the specification, and it is possible to set a precise relief pressure.

Further, in the setting mode and the selection mode, it is possible to select the relief pressure following a screen display of the display/operation unit 23 and hence operations in both the modes are easy. Moreover, since the display/operation unit 23 is shared in both the setting mode and the selection mode, it is advantageous in terms of equipment cost and space.

The above embodiment exemplifies the case where the display portion for displaying the relief pressure on the screen in both the setting mode and the selection mode and the operation portion for setting the relief pressure in the setting mode and selecting the relief pressure in the selection mode are integrated as the display/operation unit 23. However, the display portion and the operation portion may be separately provided.

The above embodiment exemplifies the case where the compression crushing apparatus and the breaker are subjects to which the present invention is applied. However, it is possible to apply the present invention to other working apparatuses as mentioned above.

Although the invention has been described with reference to the preferred embodiments in the attached figures, it is noted that equivalents may be employed and substitutions made herein without departing from the scope of the invention as recited in the claims.

We claim:

1. A relief pressure switching apparatus for hydraulic working machine, comprising:

a hydraulic actuator circuit, a relief pressure of the hydraulic actuator circuit being switched in accordance with the type of a working apparatus to be installed;

electromagnetically variable relief valves for determining the relief pressure; and a controller for storing a plurality of relief pressures preliminarily set in combination with a flow rate of oil, and commanding a relief pressure selected from the stored relief pressures as matching the working apparatus to said relief valves, wherein said controller is adapted to be switched between a setting mode for setting a plurality of relief pressures and a selection mode for selecting a relief pressure from the plurality of relief pressures set in the setting mode, and in the setting mode, by the controller, the relief pressure is set on the basis of a sensed pressure generated when a hydraulic actuator is brought into action at a predetermined flow rate of the working apparatus to be installed.

2. The relief pressure switching apparatus for hydraulic working machine according to claim 1, wherein:

a display portion for displaying the relief pressure on a screen of a display device in the setting mode and the selection mode, and an operation portion for setting the relief pressure in the setting mode and selecting the relief pressure in the selection mode are provided.

3. The relief pressure switching apparatus for hydraulic working machine according to claim 1, wherein a compression crushing apparatus of an openable and closable type and a breaker of an oscillating type are selectively installed as the working apparatus, and said controller stores the plurality of relief pressures preliminarily set in combination with the predetermined flow rate for both the compression crushing apparatus and the breaker, and commands the relief pressure selected for the installed working apparatus to said relief valves.

4. The relief pressure switching apparatus for hydraulic working machine according to claim 3, wherein said controller is adapted to store and select the plurality of relief pressures on both the oil supply and oil discharge sides to and from the hydraulic actuator for the compression crushing apparatus, and the plurality of relief pressures only on the oil supply side to the hydraulic actuator for the breaker.

* * * * *